US005717156A

United States Patent [19]

Lenkarski

[11] Patent Number: 5,717,156

[45] Date of Patent: Feb. 10, 1998

[54] SEMI-AUTOMATIC PISTOL

[75] Inventor: Lee M. Lenkarski, Ware, Mass.

[73] Assignee: Smith & Wesson Corp., Springfield, Mass.

[21] Appl. No.: 600,230

[22] Filed: Feb. 12, 1996

[51] Int. Cl.[6] ..... F41A 5/00

[52] U.S. Cl. ..... 89/196; 42/15; 42/16; 42/17; 42/18

[58] Field of Search ..... 89/196; 42/15, 42/16, 17, 18

[56] References Cited

U.S. PATENT DOCUMENTS

| | | | |
|---|---|---|---|
| 747,585 | 12/1903 | Browning | 89/196 |
| 989,432 | 4/1911 | Schmeisser | 89/196 |
| 1,181,416 | 5/1916 | Wesson | 89/196 |
| 1,377,629 | 5/1921 | Rosebush | 89/196 |
| 1,382,197 | 6/1921 | Jolidon | 89/196 |
| 3,110,223 | 11/1963 | Schlappich | 89/196 |
| 3,696,706 | 10/1972 | Seibel et al. | 89/196 |
| 3,728,939 | 4/1973 | Wilhelm | 89/196 |
| 3,894,474 | 7/1975 | Tanfoglio | 89/148 |
| 4,542,606 | 9/1985 | Hoenig | 89/196 |
| 4,593,601 | 6/1986 | Smith | 89/199 |
| 4,754,689 | 7/1988 | Grehl | 89/196 |
| 4,825,744 | 5/1989 | Glock | 89/145 |
| 4,916,843 | 4/1990 | Beretta | 89/196 |
| 5,050,481 | 9/1991 | Knight, Jr. | 89/147 |
| 5,086,578 | 2/1992 | Lishness et al. | 42/69.02 |
| 5,325,617 | 7/1994 | Vojta et al. | 42/75.03 |
| 5,581,046 | 12/1996 | Weldle et al. | 89/196 |

*Primary Examiner*—J. Woodrow Eldred

*Attorney, Agent, or Firm*—McCormick, Paulding & Huber

[57] ABSTRACT

A semi-automatic pistol includes a polymeric frame, a barrel secured to the frame medially of its front end and rear end. A slide is slidable relative to the frame without direct engagement therewith. A retainer and guide member is removably secured adjacent a rear portion of the frame and includes a pair of outwardly extending guides. Each of the guides slidably fits within one of a pair of opposing inwardly facing longitudinal grooves. Each of the grooves is disposed along opposed inner surface portions of the slide for retaining and guiding the slide in generally parallel spaced relation to the frame. The pistol includes a second retainer and guide means adjacent the front end and includes, at least in part, a generally circular aperture in a depending front wall of the slide and wherein the muzzle end of the barrel extends through the aperture. The aperture has a predetermined chamfer to enable the slide to disassembled from the pistol after the first retainer has been disconnected from the frame. The chamfer thereby enables the freed, rear end portion of the slide to be pivoted upwardly to a substantial angle generally related to the chamfer whereby the slide may be removed from the barrel and thus disassembled from the pistol.

7 Claims, 2 Drawing Sheets

SEMI-AUTOMATIC PISTOL

FIELD OF THE INVENTION

This invention relates to compact, lightweight pistols and more particularly to such pistols as include a polymer frame and metal slide in which there is no direct engagement of the slide and frame assembly and a take-down system for disassembly of the slide and frame of the pistol.

BACKGROUND OF THE INVENTION

In recent years there has been a trend in the handgun industry to utilize polymers in the manufacture of semi-automatic and automatic pistols, particularly in fabricating unitary frames therefor by injection molding techniques. Generally, such frames are adapted to receive a metal slide removably fitted onto the frame for slidable reciprocal movement therealong. The slide is usually secured for such movement by longitudinally spaced pairs of metal rails partially embedded in the polymer of the frame. The rails provide durable metal-to-metal contact, as with tongue and groove fittings for slidable inter-engagement between the frame and slide which are characterized by superior wear and reliable operation.

In U.S. Pat. No. 3,696,706, issued on Oct. 10, 1972, and assigned to Heckler & Koch, for example, a pistol is disclosed wherein a metal slide and breech block combination is slidably mounted on a frame support member constructed entirely of a synthetic resin material. The breech end of the barrel is disposed within a mounting block which has a lower base portion embedded into the plastic material of the frame. The plastic frame is provided with parallel metal ribs or guide projections 9 embedded in the frame and adapted to engage grooves 11 on the breech assembly. Such projecting guides and grooves provide for reciprocal longitudinal movement of the slide relative to the frame. The gun barrel is housed within the forward portion of the slide and includes a downwardly extending block portion that interfits within a recess provided in the upper portion of the frame to hold the barrel in a given longitudinal position relative to the slide.

When such pistols are fired, the slide is moved rearward by blow-back along the upper surface of the frame. In addition, in some models, the breech end of the barrel will be pivoted downward to receive the next round of ammunition picked up from the magazine by the breech block and rammed into the chamber of the barrel. In other models, as disclosed in the '706 Patent, the barrel is stationary and contributes to the guidance of the slide.

With the advent of ever improving polymers in recent years, polymer frame pistols of the type disclosed in U.S. Pat. No. 5,386,659, dated Feb. 7, 1995, and assigned to the same assignee as this application, have been gaining greater market acceptance. Moreover, included among those who have signified their increasing acceptance of these types of pistols are many professional gun users, such as personnel of various Federal, State and local law enforcement agencies.

Although the pistol disclosed herein is much smaller in every respect than the pistols embodying the invention disclosed in the '659 Patent, it was found that merely scaling down the larger dimensions would not yield reductions in manufacturing costs commensurate with the size and weight reductions of the pistol. Instead, it was almost necessary to make changes "lock, stock and barrel", or more precisely, to change substantially the slide, frame and barrel, as well as the manner of their assembly and disassembly, as will be hereinafter described.

For proper maintenance, pistols require disassembly or "take-down" for periodic cleaning and inspection of the internal parts thereof. The first step in such "take-down" procedure generally involves removal of the slide and barrel from the frame. This step usually entails actuating some type of latch or interlock release mechanism which frees up the slide so that it, together with the barrel can then be removed by sliding it forwardly and off the frame.

SUMMARY OF THE INVENTION

Accordingly, it is the general object of the present invention to provide a compact, lightweight and economical pistol having a polymer frame and metallic slide.

It is another object of the present invention to provide a pistol of the above type which has constructional features which provide for improved assembly and disassembly of the components of such a pistol.

According to the present invention, a pistol includes a polymer frame, a barrel having a breech end fitted into a preformed chamber and base portion adapted to be affixed to the frame. A slide has its "after-end" slidably disposed in spaced relation to the frame by a discrete retainer and guide member removably attachable to said frame. The forward end of the slide has a depending wall with an aperture therethrough that slidably fits about the muzzle end portion of the barrel for retention of the forward end portion of the slide for guiding the reciprocal movement of the slide relative to the barrel and the frame on which the barrel is fixedly mounted. The retainer and guide member includes upwardly extending arm portions which terminate at their upper ends in a pair of guide rails. The guide rails are adapted to interfit slidably with a pair of longitudinal grooves disposed generally in the rear end portion of the slide. Each of the grooves has a length at least equal to the length of recoil of the pistol. With removal of the retainer, the rear end portion of the slide may be swung or pivoted upwardly from the frame to a sufficient divergent relationship to enable removal of the slide from the frame without removal of the barrel. The aperture in the forward wall of the slide includes a chamfered edge portion to enable the rear end portion of the slide to be pivoted upwardly of the frame for removal therefrom, as aforesaid.

The above and other objects and advantages of this invention will become more readily apparent when the following description is read in conjunction with the accompanying drawings.

DETAILED DESCRIPTION OF THE PREFERRED EMBODIMENTS

Figure 1:
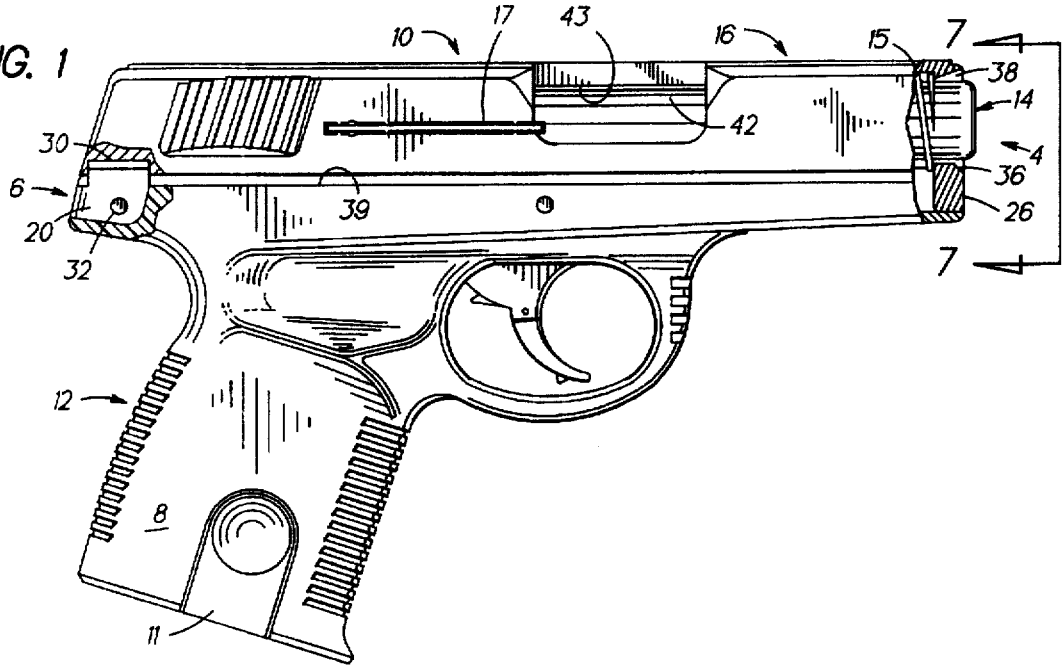
FIG. 1 is a side elevational view of a handgun or pistol of the type embodying the present invention and with parts in section to reveal structural features of the invention.

Referring to FIG. 1, a preferred embodiment of a pistol of the type embodying the present invention is shown generally at 10. The pistol comprises a polymer frame 12, and a barrel 14 affixed medially of the forward end 4 and after-end 6 of the pistol. A slide 16 is disposed for reciprocal movement relative to the barrel and frame.

The frame 12 is preferably a unitary structure fabricated by injection molding a high strength, heat and corrosion resistant polymer, such as Nylon 66. Unlike heretofore available pistol frames, the frame 12 does not include metallic structural components embedded partially into the molded polymer so as to serve as rails or guides for durable wear-resistant sliding contact with the reciprocable metal slide 16.

Figure 4:
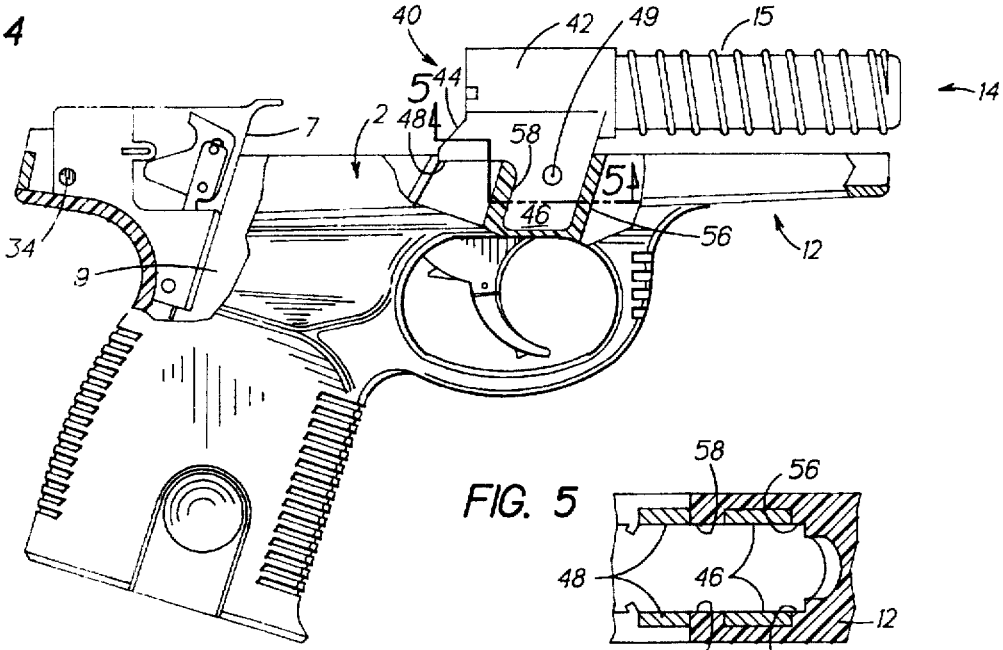
FIG. 4 is a side elevational view of the pistol of FIG. 1 with the slide removed and with portions of the frame cut away.
Figure 5:
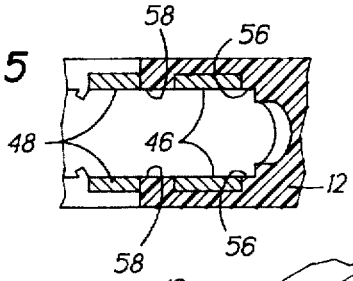
FIG. 5 is a section taken along line 5—5 of FIG. 4 showing constructional details of a polymeric frame in accordance with this invention.
Figure 7:
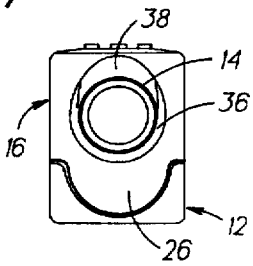
FIG. 7 is a front elevational view of the slide and frame of the pistol taken along line 7—7 of FIG. 1.

As will be noted in FIGS. 4 and 5, the frame 12 comprises an upwardly open channel 2 extending over the length of the frame generally from one end 4 to the other end 6 thereof. A handgrip portion 8 of ergonomic configuration is also shown of the type disclosed in U.S. Pat. No. 5,406,731, granted on Apr. 18, 1995. The frame is adapted to house the firing mechanism 7 and the barrel 14. The handgrip 8 defines a downwardly and upwardly opening chamber 9 adapted to removably receive therein a magazine 11 of the type disclosed in a copending application Ser. No. 08/504,505, filed on Jul. 20, 1995 and which is assigned to the same assignee as this application.

The slide 16, as its name suggests, is the member which performs the actions resulting from pulling the trigger and, as disclosed in U.S. Pat. No. 5,386,659, granted on Feb. 7, 1995, to the same assignee as this application, causes movement of the sear of the firing mechanism. As disclosed in the '659 Patent, the sear coacts with a striker type firing pin (not shown) disposed in the breech block in the rear end portion of the slide 16 with the result being that the firing pin would be cocked and released. Assuming a round is in the chamber, it would be fired. As a result of the energy released thereby, the breech block and slide 16 would be moved rearward and in doing so it would compress the recoil spring 15. During recoil, the empty shell casing would be extracted from the chamber of the barrel 14 by an extractor 17 and expelled through the opening 19 in the slide 16. Compression of the recoil spring 15 would continue until the kinetic energy, having been imparted to the slide 16, is reduced to a level wherein the potential energy being imparted to the recoil spring as it is being compressed, becomes greater than the kinetic energy. When that occurs, the recoil spring 15 will begin to expand and, in so doing, will return the slide 16 to its forward position.

Figure 6:
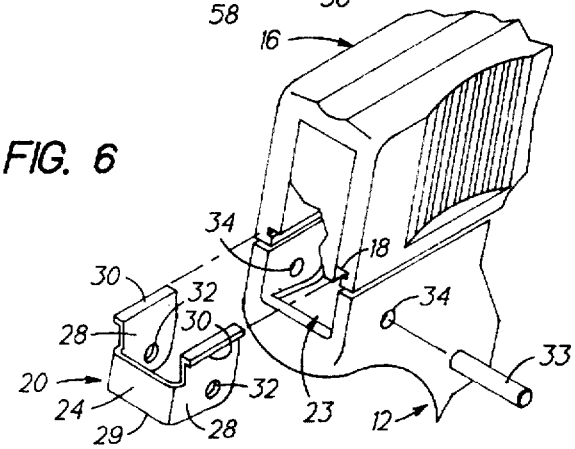
FIG. 6 is a perspective view of a partially exploded view of the rear portion of the pistol of FIG. 1.

A pair of opposed, inwardly opening and longitudinally extending grooves 18 are disposed at the rear end of the slide 16 as best shown in FIG. 6. The grooves 18 are dimensioned, configured, oriented and spaced apart to engage a combination retainer and guide member 20 adapted to be releasably secured within the after-end portion of the frame, as at 23.

The retainer and guide member 20, as shown in FIG. 6, is generally a unitary, U-shaped steel stamping and includes a cross-bar portion 24, a pair of parallel arms 28 which extend outwardly in spaced parallel relation from the outer edge portions of the cross-bar. Each arm 28 also includes an upwardly extending portion that terminates in an outwardly extending guide rail 30. Each of the guide rails 30 is adapted to provide a sliding fit within each of the grooves 18. To secure the slide onto the frame, the retainer 20 need be simply inserted into opening 23 in the rear surface 35 of the frame so that holes 32 are laterally aligned with holes 34 through corresponding locations of the side walls of the frame 12. A tapered, spring pin 33 is dimensioned to fit snugly into two pairs of holes 34 and 32 through the walls of the frame and the arms of the retainer 20. Additionally, the firing mechanism 7, as shown in FIG. 4, may also include a hole 34 so that the mechanism may also be secured in place in the frame 12. Preferably, the two pairs of holes are disposed respectively on the retainer and frame so that when disposed in such lateral alignment, the outer surface of the cross-bar portion 24 will generally be flush with the remainder of the rear wall of the frame.

Figure 2:
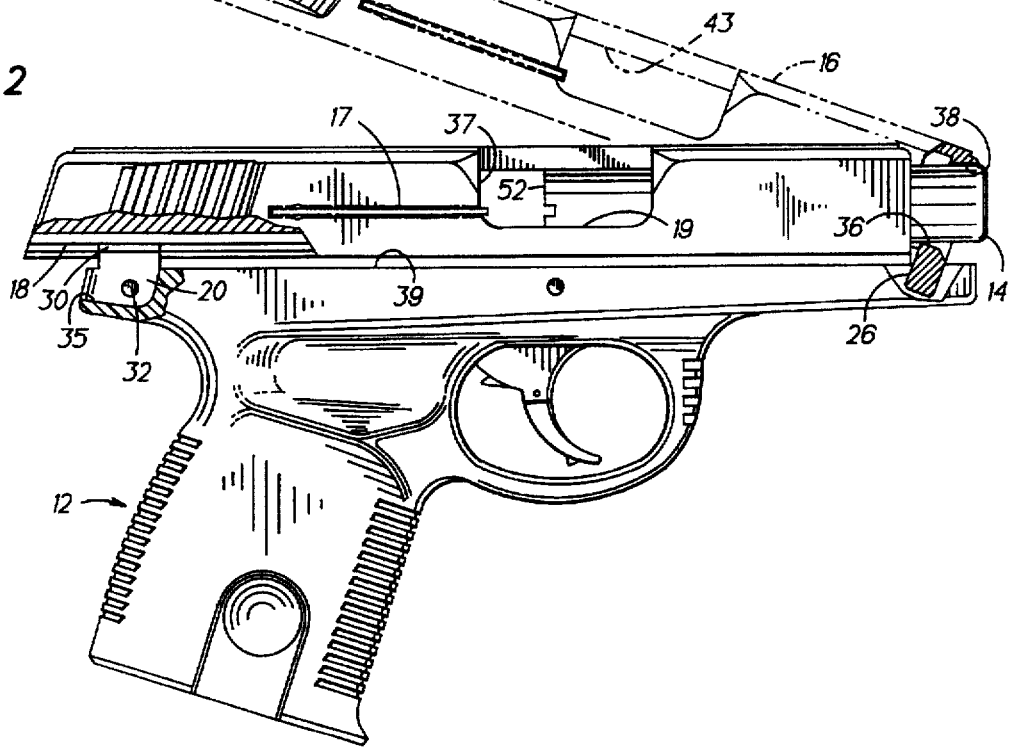
FIG. 2 is a side elevational view of the pistol of FIG. 1 with parts thereof in different operative relation and which includes a phantom showing to illustrate a step in the disassembly of the pistol.

In addition, the arm portions 28 of the retainer 20 are shaped such that when the lower edge 29 of the retainer is disposed flush on the upper surface 35 of the rear portion of the frame 12, as illustrated in FIG. 2, the guide rails 30 are generally disposed parallel with the grooves 18 in the slide. In this way, the discrete retainer 20 secures, supports, retains and guides the rear portion of the slide during its reciprocal movement as a result of blow-back of the slide which compresses recoil spring 15 and its ensuing forward movement by the consequent expansion of the recoil spring 15.

The forward portion of the slide 16 is retained, supported and guided during its movement by the interrelationship of the barrel 14 and slide 16. In that regard, an aperture 36, as shown in FIG. 1 is provided through a front end wall 26 of the slide 16 and which is adapted to receive therethrough the muzzle end of the barrel 14. Both the retainer 20 and the fixed barrel 14 retain the slide 16 in its assembled and parallel relation to the upper edges 39 of the frame 12 and guide its reciprocal, longitudinal motion therealong which occurs whenever the handgun 10 is fired.

Figure 3:
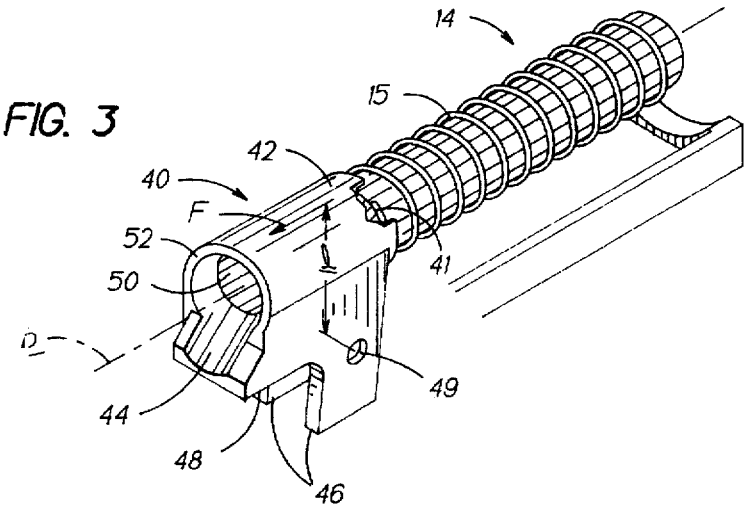
FIG. 3 is a perspective view of a gun barrel, a recoil spring and enlarged multi-functional breech member of the type embodying this invention.

In the preferred embodiment, as shown in FIGS. 1, 3 and 4, the recoil spring 15 is concentrically disposed about the barrel 14 with one end thereof seated against the inner surface of depending front wall 26 of the slide 16. The other end of the spring 15 is seated against a recessed shoulder portion 41 of a cylindrical portion 42 of a casting disposed about the chamber 50 of the barrel 14. The outer diameter of the cylinder 42 is sufficiently greater than the outer diameter of the spring so that operation of the spring in urging the slide 12 to its forwardmost position, absorbing the force of recoil and returning the slide to its forwardmost position, will not interfere with the movement of the slide even though its movement is supported by the outer surface of the cylinder 42.

Since the breech block 37 (FIG.2) is disposed in the rear portion of the slide, the recoil spring 15 releasably urges the breech block forwardly so that it is normally engaged with the breech 52 of the barrel.

The barrel comprises a barrel 14, per se, combined in a unitary structure with an enlarged casting 40 disposed at the breech end portion of the barrel. As best illustrated in FIG. 3, the casting 40 includes the cylindrical portion 42 disposed about the chamber 50 within the breech end 52 of the barrel, an inclined ramp 44 of concave cross-section to guide a bullet upwardly into the chamber of the barrel and a pair of laterally spaced and forwardly inclined leg portions 46. A pair of stabilizer ridges 48 extend rearwardly of each leg 46, at least one of which is adapted to engage the thickened rib portions 56, 58 of the frame 12 to ensure the stability and immobility of the barrel as mounted in the frame 12.

Since "recoil" is the reactive force "equal and opposite to" the force required to accelerate a bullet from the muzzle of the barrel with sufficient initial velocity to strike a target at a given distance with a forceful impact, its dissipation must be controlled. As well known to those skilled in the art, recoil acts against the cartridge casing and to the breech block 37 which will, therefore, be driven rearwardly whereby the recoil spring 15 will be compressed and its subsequent expansion will return the slide to its forward position. During its cycle of compression and expansion of the spring 15, some of the energy of recoil will have been dissipated by the work done in compressing the recoil spring. Additional energy will be dissipated by the breech block in extracting and ejecting the empty cartridge case from the chamber, in repositioning the sear and firing pin to their ready-to-fire positions, in picking up the uppermost round from the magazine 11, moving that round up the ramp 44 and ramming it forcefully into the chamber. To avoid any problems of the rounds of ammunition becoming jammed when being rammed into the chamber the slide must have sufficient momentum during the final stage of its round trip of first compressing the recoil spring and then being driven forwardly by expansion of the recoil spring. Without attempting to isolate any particular portion of the recoil and/or counter-recoil cycle, suffice it to say that substantial forces are imparted to the frame 12 via the barrel 14 at the interface of the rear end of the recoil spring 15 and undercut seat provided on the forward end of the cylindrical portion 42 of the casting.

As illustrated in FIG. 3, the force E transferred to the frame is disposed along the axis of the barrel b which is applied above the mounting pin holes 49 of the legs by a distance 1. This force couple would have a tendency to rotate the barrel mounting 40 rearward but that the ridges 48 have proven satisfactory for countervailing this relatively large destabilizing force without adding any substantial increase to the manufacturing costs of the pistol.

The enlarged casting 40 may be formed of any suitable alloy adapted to carryout the various functions which the various parts are required to perform. In addition to those functions already alluded to, the cylindrical portion 42 will also serve as an additional guide and support surface for the inner cylindrical surface 43 of the slide 16 (FIG. 1) having a radius of curvature substantially the same as that of the outer surface of the cylindrical portion 42 of the casting 40. As shown in FIG. 1, the lower surface of the barrel 14 may also serve to guide the forward portion of the slide since the inner surface of the aperture 36 has a radius of curvature only slightly larger that of the outer diameter of the barrel. The effect of providing a barrel and slide arrangement, as described, is that a pistol embodying this invention includes a second retainer and guide member in addition to that shown at 20 in FIG. 6. Moreover, that guide member is engageable with grooves 18 of sufficient length for interengagement over the full length of the recoil and counter-recoil movement of the slide relative to the frame.

Referring to FIGS. 1 and 2, the aperture 36, disposed in the forward wall 26 of the slide 16, is generally circular at the inner surface of the wall 26 and has a diameter which is slightly greater than the outer diameter of the barrel 14. The upper portion of the aperture 36 flares outwardly, as at 38, from the inner to the outer surface of the wall 26 to provide a chamfered sector 38. The chamfer 38 enables the rear end of the slide 16 to be pivoted upwardly approximately 20° about its forward end, as depicted in FIG. 2, when the retainer 20 has been disconnected from the slide 16. In that way, the slide can be readily removed from the frame by swinging its rear end portion to the aforesaid angular relation to the frame. This same angular relationship provides sufficient clearance to enable the breech block portion 37 of the slide 16 to clear the breech end 52 of the barrel 14 by simply moving the slide forwardly at that angular relation to uncouple the front wall 26 from the muzzle end of the barrel. In effect, the barrel 14 and apertured front wall 26 serve as a second retainer and guide member operable sequentially only after the first retainer has been used to release the rear end of the frame 12. In addition, as shown in FIGS. 2 and 3, the upper surface of the cylindrical portion 42 of the breech casting 40 serves as means for guiding the concave, inner, cylindrical surface 43 of the upper portion of the slide 16 parallel to the upper edges of the frame 12. Also, the lower surface of the barrel 14 and of the aperture 36 of the front wall 26 of the slide serve as guide means for the front portion of the slide.

In the disassembly, or take-down of a pistol of the type embodying this invention, the first step is removal of the pin 33. The retainer and guide member may be removed from the rear end of the frame 12, thus freeing up the rear end portion of the slide 16 which can then be pivoted upward and removed, as described above. To reassemble the handgun 10, the process just described is reversed. The slide 16 is fitted onto the forward end of the barrel 14 at an angle of approximately 20° relative to the upper surface 39 of the frame 12. The rear end of the slide 16 may then be pivoted downward into generally parallel relation with the frame 12, as shown in FIGS. 2 and 6. The retainer and guide member 20 may be fitted into the opening 23 as heretofore described, with its guide rails 30 engaged with grooves 18 in the slide. The reassembly is completed by reinserting the pin 33 into the aligned holes 34 and 32.

Although this invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. In an improved semi-automatic pistol that includes a polymeric frame having a front end, a rear end, laterally spaced side walls, a hand grip with a chamber therein for receiving therein a magazine, a firing mechanism removably fitted into the frame rearwardly of the magazine, a barrel and a metallic slide including a breech block carried by said slide and having a firing pin disposed therein and said slide including an apertured front wall, a rear wall and laterally spaced side walls disposed in vertically spaced relation to said frame, an improvement comprising the barrel being fixedly mounted medially of the front and rear end of the frame, and a metal retainer and guide member removably secured to the frame adjacent the rear end thereof and comprising a pair of rails that slidingly interfit within longitudinally extending grooves formed in the slide for guiding longitudinal movement of the slide relative to the frame.

2. An improved semi-automatic pistol, as set forth in claim 1, wherein the aperture through the front wall of the slide is chamfered to enable the rear end of the slide to be raised to a given angle in relation to the frame when said retainer has been removed so that it is not guiding the longitudinal sliding movement of the slide for removal of the slide from the barrel and frame.

3. An improved semi-automatic pistol, as set forth in claim 1, wherein the retainer is generally U-shaped having a rear cross-bar portion and laterally-spaced arm portions, each of which has an upper portion that extends outwardly of each arm to provide said rails.

4. An improved semi-automatic pistol, as set forth in claim 3, wherein each of said arm portions includes a hole through corresponding locations in said arms and is adapted to receive a pin therein, said retainer being dimensioned and shaped such that when the holes in said arms are laterally aligned with holes in the frame and said pin is inserted into the aligned holes, the retainer will be secured in position for guiding the movement of the slide relative to the frame.

5. An improved semi-automatic pistol, as set forth in claim 2, wherein the barrel includes an enlarged casting disposed about the breech portion of the gun barrel, per se, and including a cylindrical portion disposed about the breech portion of the barrel and having an outer diameter greater than the diameter of said barrel, a recoil spring coaxially disposed about the barrel and having one end seated against an undercut forward edge of said cylindrical portion and its opposite end in contact with the apertured front wall of the slide, whereby the outer surface of the cylinder may be a guide surface for maintaining movement of the slide generally parallel to the upper surfaces of the side edges of the frame and in which the muzzle end of the barrel extends through said aperture in the front wall of said slide.

6. An improved semiautomatic pistol, as set forth in claim 5, wherein said aperture has a radius of curvature not substantially different from the radius of the barrel so that the barrel may also serve to guide movement of the slide generally parallel to said side edges of the frame.

7. An improved semiautomatic pistol, as set forth in claim 6, wherein said aperture has a chamfered sector which enables the apertured front wall to serve as a second retainer adapted for maintaining the slide and frame in generally parallel relation to each other and where the front wall can be separated from said barrel only after the retainer and guide member had been removed from the rear end of the frame so that the rear end of the slide can be moved relative to the frame whereby said slide can be pivoted upwardly from the frame to the extend of the chamfered sector.

* * * * *